US006474643B1

(12) United States Patent
Rehus

(10) Patent No.: US 6,474,643 B1
(45) Date of Patent: Nov. 5, 2002

(54) PAINTBALL SIMULATION GAME

(76) Inventor: Jimmy A. Rehus, P.O. Box 1012, Vista, CA (US) 92085

( * ) Notice: Subject to any disclaimer, the term of this patent is extended or adjusted under 35 U.S.C. 154(b) by 0 days.

(21) Appl. No.: 09/876,960

(22) Filed: Jun. 8, 2001

(51) Int. Cl.[7] ..... A63F 3/00
(52) U.S. Cl. ..... 273/255; 273/262; 273/244
(58) Field of Search ..... 273/236, 255, 273/262, 244, 259, 277

(56) References Cited

U.S. PATENT DOCUMENTS

| | | | | | |
|---|---|---|---|---|---|
| 3,455,556 | A | * | 7/1969 | Mossman | 273/146 |
| 4,572,514 | A | | 2/1986 | Aponte | |
| 4,801,148 | A | | 1/1989 | Lamb | |
| 5,020,805 | A | | 6/1991 | Fratangelo et al. | |
| 5,251,905 | A | | 10/1993 | Bomino | |
| 5,388,837 | A | | 2/1995 | Hoffman | |
| 5,496,037 | A | * | 3/1996 | Rumph | 273/255 |
| D369,626 | S | | 5/1996 | Cartwright et al. | |

* cited by examiner

*Primary Examiner*—Benjamin H. Layno
*Assistant Examiner*—Vishu K. Mendiratta

(57) ABSTRACT

A paintball simulation game for simulating a paintball game. The paintball simulation game includes a game board having game spaces thereon. A plurality of game tokens includes flag shaped game tokens and game pieces. A plurality of obstacle pieces includes a plurality of water pieces having zero cover value and a plurality of medium cover pieces having a two cover value. A plurality of game cards has indicia thereon comprising either positive or negative actions. Dice determine movement about the game board. The players place the obstacle pieces, game pieces and flag tokens on the game board. A first player draws one of the cards and performs the indicia thereon. The first player next rolls the dice and moves the game pieces a number of game spaces indicated on the die. The first player may then attack the opponent's game piece by determining if the opponent's defending game piece is within shooting range of an attacking player's attacking game piece. The attacking player rolls a die and adds to the number on the die to the attacking player's cover value to get a first number. The defending player rolls a die and adds to the number on the die to the defending player's cover value to get a second number. The defending game piece is removed from the game board if the first number is greater than the second number. The game is won by capturing an opponents flag.

18 Claims, 3 Drawing Sheets

PAINTBALL SIMULATION GAME

BACKGROUND OF THE INVENTION

1. Field of the Invention

The present invention relates to board games and more particularly pertains to a new paintball simulation game for simulating a paintball game.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,251,905; U.S. Pat. No. 5,388,837; U.S. Pat. No. 4,572,514; U.S. Pat. No. 5,020,805; U.S. Pat. No. 4,801,148; and U.S. Des. Pat. No. 369,626.

While these devices fulfill their respective, particular objectives and requirements, the aforementioned patents do not disclose a new paintball simulation game. The inventive device includes a game board having a plurality of grid line indicia thereon to form game spaces. A plurality of game tokens includes at least two of the game tokens having a flag shape. A portion of the game tokens defines game pieces. A plurality of obstacle pieces includes a plurality of water pieces and a plurality of medium cover pieces. Water pieces define a cover value equal to zero and medium cover defines a cover value equal to 2. Each of a plurality of game cards has a side has indicia thereon comprising either positive or negative actions. A chance means determines movement about the game board and includes a plurality of dice. The players place the obstacle pieces on the game board and each choose a flag for positioning on the game board. Each player also places their game pieces on the game board. A first player draws one of the cards and performs the indicia thereon. The first player next rolls the dice. The game pieces are moved a number of game spaces indicated on the die. The first player may then attack the opponent's game piece. Attacking the opponent's game piece includes determining an attacking game piece and a defending game piece and determining if the opponent's defending game piece is within shooting range of an attacking player's attacking game piece. The attacking player rolls a die and adds to the number on the die to the attacking player's cover value to get a first number. The defending player rolls a die and adds to the number on the die to the defending player's cover value to get a second number. The defending game piece is removed from the game board if the first number is greater than the second number. The game is won by placing one of the game pieces on a game space is occupied by an opponent's flag shaped game token.

In these respects, the paintball simulation game according to the present invention substantially departs from the conventional concepts and designs of the prior art, and in so doing provides an apparatus primarily developed for the purpose of simulating a paintball game.

SUMMARY OF THE INVENTION

In view of the foregoing disadvantages inherent in the known types of board games now present in the prior art, the present invention provides a new paintball simulation game construction wherein the same can be utilized for simulating a paintball game.

The general purpose of the present invention, which will be described subsequently in greater detail, is to provide a new paintball simulation game apparatus and method which has many of the advantages of the board games mentioned heretofore and many novel features that result in a new paintball simulation game which is not anticipated, rendered obvious, suggested, or even implied by any of the prior art board games, either alone or in any combination thereof.

To attain this, the present invention generally comprises a game board having a plurality of grid line indicia thereon to form game spaces. A plurality of game tokens includes at least two of the game tokens having a flag shape. A portion of the game tokens defines game pieces. A plurality of obstacle pieces includes a plurality of water pieces and a plurality of medium cover pieces. Water pieces define a cover value equal to zero and medium cover defines a cover value equal to 2. Each of a plurality of game cards has a side has indicia thereon comprising either positive or negative actions. A chance means determines movement about the game board and includes a plurality of dice. The players place the obstacle pieces on the game board and each choose a flag for positioning on the game board. Each player also places their game pieces on the game board. A first player draws one of the cards and performs the indicia thereon. The first player next rolls the dice. The game pieces are moved a number of game spaces indicated on the die. The first player may then attack the opponent's game piece. Attacking the opponent's game piece includes determining an attacking game piece and a defending game piece and determining if the opponent's defending game piece is within shooting range of an attacking player's attacking game piece. The attacking player rolls a die and adds to the number on the die to the attacking player's cover value to get a first number. The defending player rolls a die and adds to the number on the die to the defending player's cover value to get a second number. The defending game piece is removed from the game board if the first number is greater than the second number. The game is won by placing one of the game pieces on a game space is occupied by an opponent's flag shaped game token.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new paintball simulation game apparatus and method which has many of the advantages of the board games mentioned heretofore and many novel features that result in a new paintball simulation game which is not anticipated, rendered obvious, suggested, or even implied by any of the prior art board games, either alone or in any combination thereof.

It is another object of the present invention to provide a new paintball simulation game which may be easily and efficiently manufactured and marketed.

It is a further object of the present invention to provide a new paintball simulation game which is of a durable and reliable construction.

An even further object of the present invention is to provide a new paintball simulation game which is susceptible of a low cost of manufacture with regard to both materials and labor, and which accordingly is then susceptible of low prices of sale to the consuming public, thereby making such paintball simulation game economically available to the buying public.

Still yet another object of the present invention is to provide a new paintball simulation game which provides in the apparatuses and methods of the prior art some of the advantages thereof, while simultaneously overcoming some of the disadvantages normally associated therewith.

Still another object of the present invention is to provide a new paintball simulation game for simulating a paintball game.

Yet another object of the present invention is to provide a new paintball simulation game which includes a game board having a plurality of grid line indicia thereon to form game spaces. A plurality of game tokens includes at least two of the game tokens having a flag shape. A portion of the game tokens defines game pieces. A plurality of obstacle pieces includes a plurality of water pieces and a plurality of medium cover pieces. Water pieces define a cover value equal to zero and medium cover defines a cover value equal to 2. Each of a plurality of game cards has a side has indicia thereon comprising either positive or negative actions. A chance means determines movement about the game board and includes a plurality of dice. The players place the obstacle pieces on the game board and each choose a flag for positioning on the game board. Each player also places their game pieces on the game board. A first player draws one of the cards and performs the indicia thereon. The first player next rolls the dice. The game pieces are moved a number of game spaces indicated on the die. The first player may then attack the opponent's game piece. Attacking the opponent's game piece includes determining an attacking game piece and a defending game piece and determining if the opponent's defending game piece is within shooting range of an attacking player's attacking game piece. The attacking player rolls a die and adds to the number on the die to the attacking player's cover value to get a first number. The defending player rolls a die and adds to the number on the die to the defending player's cover value to get a second number. The defending game piece is removed from the game board if the first number is greater than the second number. The game is won by placing one of the game pieces on a game space is occupied by an opponent's flag shaped game token.

Still yet another object of the present invention is to provide a new paintball simulation game that may be made into multiple games by varying the goals and number of game pieces to be used.

Even still another object of the present invention is to provide a new paintball simulation game that teaches strategy.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
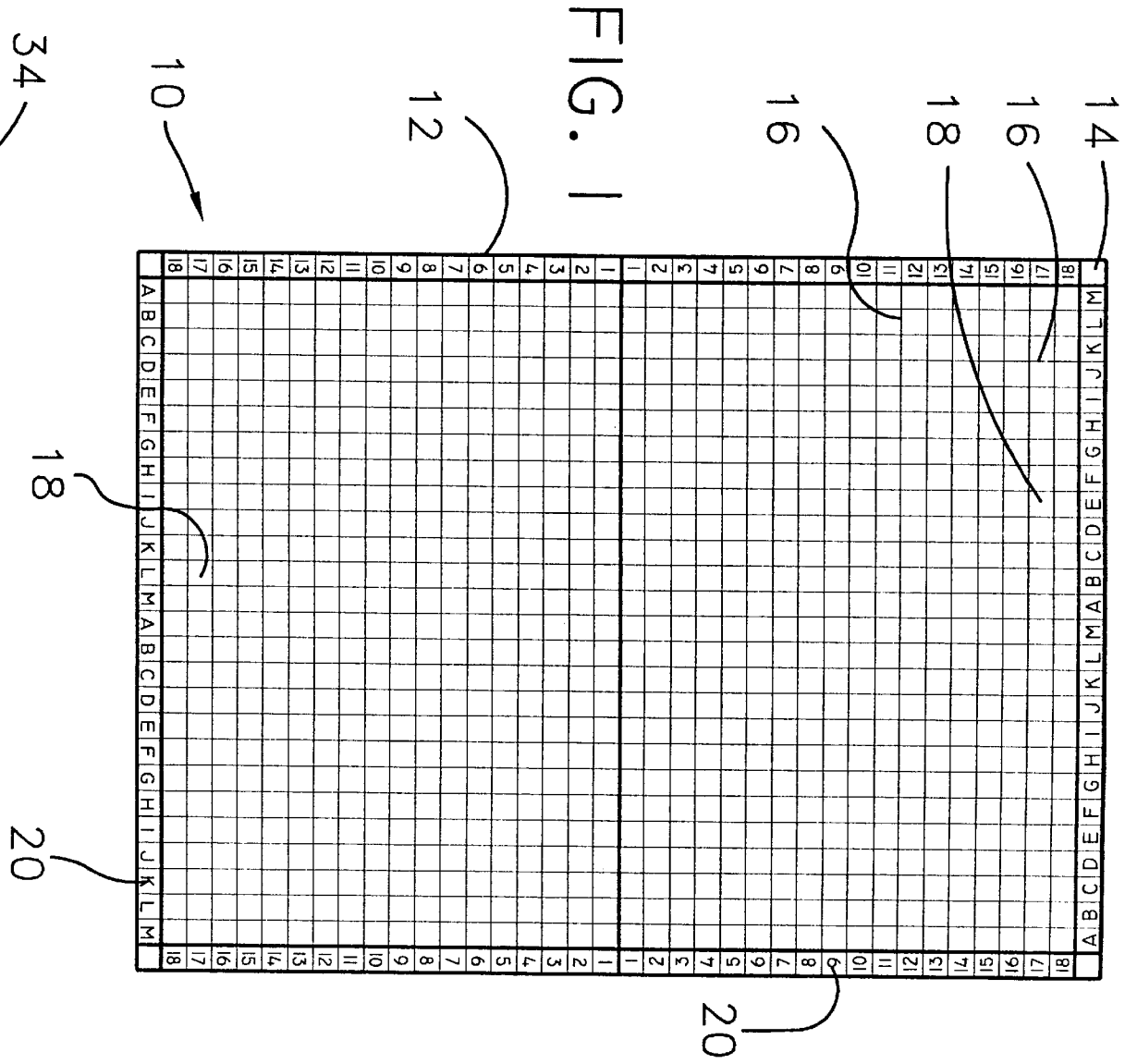
FIG. 1 is a schematic plan view of the game board of a new paintball simulation game according to the present invention.
Figure 2:
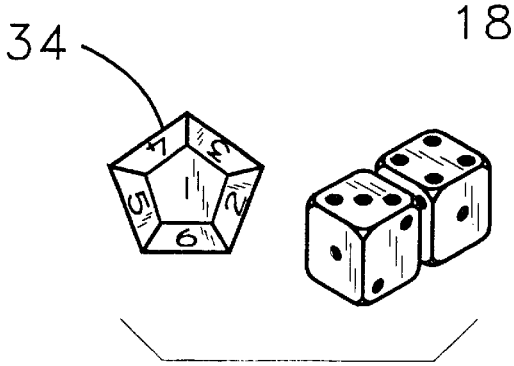
FIG. 2 is a schematic perspective view of the dice of the present invention.
Figure 3:
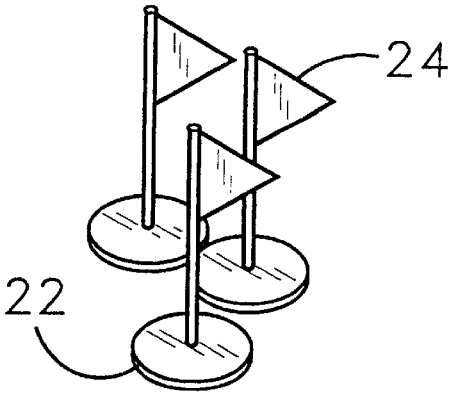
FIG. 3 is a schematic perspective view of the flags of the present invention.
Figure 4:
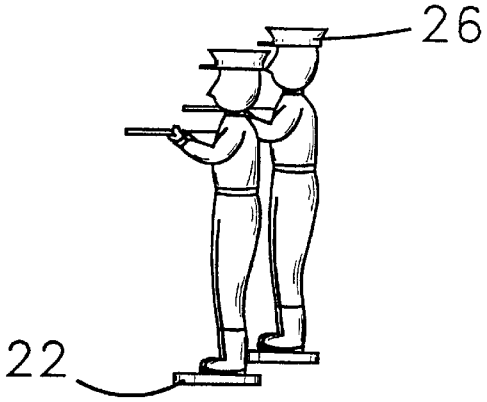
FIG. 4 is a schematic side view of the game pieces of the present invention.
Figure 5:
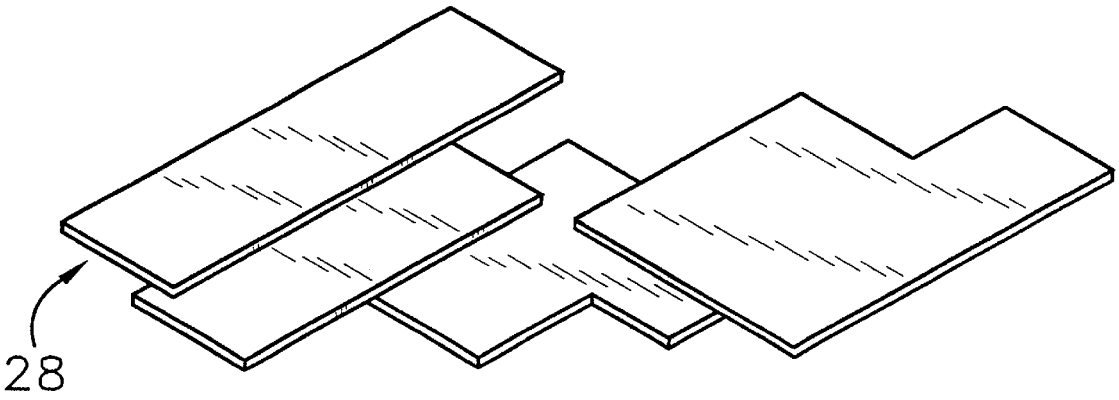
FIG. 5 is a schematic perspective view of the water, medium cover and heavy cover obstacles of the present invention.
Figure 6:
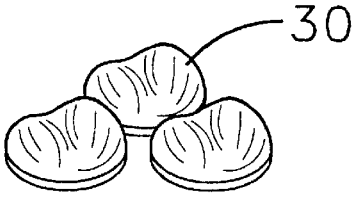
FIG. 6 is a schematic perspective view of the rock pieces of the present invention.
Figure 7:
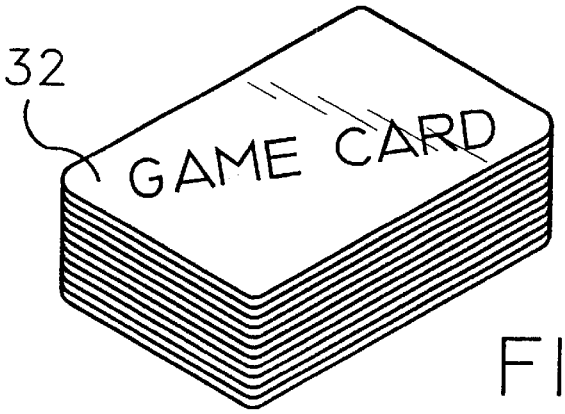
FIG. 7 is a schematic perspective view of the card of the present invention.

With reference now to the drawings, and in particular to FIGS. 1 through 6 thereof, a new paintball simulation game embodying the principles and concepts of the present invention and generally designated by the reference numeral 10 will be described.

As best illustrated in FIGS. 1 through 6, the paintball simulation game 10 generally comprises a game board 12. The game board 12 has a top side 14 and a bottom side, not shown. The top side has a plurality of grid line 16 indicia thereon such that game spaces 18 are defined. The top side 14 is colored a relatively light green color. The top side defines light cover. The light cover has a cover value equal to 1. The game board 12 preferably comprises a magnetically receptive material such as metal. The game board 12 may have letters 20 and numbers along its peripheral edge as shown in FIG. 1 such that coordinates may be used.

Each of a plurality of game tokens preferably has a base wall 22. Each of the base walls 22 comprises a conventional magnetically active material. At least two of the game tokens has a shape resembling a flag 24. At least twenty eight of the game tokens has a shape resembling a soldier 26. The soldier shaped pieces 26 and define game pieces. Half of the game pieces 26 are preferably colored blue and half of the game pieces are colored red.

Each of a plurality of obstacle pieces 28 preferably comprises a conventional magnetically receptive material. The plurality of obstacle pieces includes a plurality of water pieces. Each of the water obstacle pieces comprises a plate having a blue color. The water pieces have a cover value equal to zero. Each of plurality of medium cover pieces comprises a plate having a relatively medium green color. The medium cover pieces have a cover value equal to 2. Each of a plurality of heavy cover pieces comprises a plate having a relatively dark green color. The heavy color pieces have a cover value equal to 3. Each of a plurality of rock pieces 30 has a shape resembling a boulder. Each of the rock pieces 30 has a gray color.

Each of a plurality of game cards 32 has a side having indicia thereon. The indicia is generally action indicia and includes positive and negative indicia. The indicia includes: normal play; your goggles fogged and you will fire and return fire at 1 less cover value; camouflaged opponent receives cover value plus 1; you are camouflaged and receive cover value plus 1; opponent's goggles fogged and will fire and return fire at 1 less cover value; custom gun adds plus 1 to your cover value; friendly fire eliminates your game piece that is nearest an opponent and within range of another of your game pieces; opponent is out of paintballs and cannot return fire for one turn; paintball exploded in opponent's gun and opponent receives cover value minus 1; paintball exploded in your gun and you receive cover value minus 1; your equipment fails and you lose one turn; opponent's equipment fails and opponent loses one turn; your sniper is detected and becomes a regular game piece; your detect opponent's sniper who becomes a regular game piece; you are out of paint balls and can not fire for 1 turn; you are out of breath and cannot fire for one turn; opponent is out of breath and cannot fire for one turn.

A chance means 34 for determines movement about the game board. The chance means preferably comprises a plurality of dice. The plurality of dice is ideally two sets of dice. Each set of dice comprises 2 twelve sided dice and 4 six sided dice. One of the sets is colored red and the other of the sets is colored blue.

Rules of the Game

Generally, the game is to be played by two players.

The game begins by each player placing one of the obstacle pieces on the game board in turn until a desired amount of obstacles are positioned on the game board. Preferably, the order of players placing the obstacle alternates and the second obstacle placed must be the same type of obstacle as the first one placed.

Each player chooses such that the players each receive the dice and the game pieces having the chosen color.

Each of the players chooses a flag and positions the flag in opposite halves of the game board in a game space. The flag may not be positioned within five game spaces of an edge of the game board. The players may decide to use multiple flags to alter the strategy of the game.

Ideally, each of the players positions twelve of the game pieces on the game board such that twenty-four game pieces are positioned on the game board. The number of game pieces may vary depending on the type of game to be played by the players. Each of the game pieces is positioned in a game space and each is positioned behind a player's flag such that the game pieces must travel past a player's own flag on route to an opponent's flag.

The players may decide if snipers are to be used. Snipers are secret and the coordinates of the snipers are written down. If an opponent is within range of a sniper, that sniper may attack the opponent. After attacking the opponent, the sniper's position is replaced with a game piece and the sniper is treated as a regular game piece. Snipers must be activated before the step of drawing a card.

The players may also use mines. Mines are also secret and their coordinates recorded. If an opponent steps on a mine, the opponent in that game space where the mine is located and all opponents located in adjacent game spaces.

The first player begins by drawing one of the cards and performing the indicia on the card if possible.

The first player next rolls the dice by the first player. When a player rolls, the player rolls 2 twelve sided dice and 4 six sided dice if the player has at least eleven game pieces remaining. The player rolls 2 twelve sided dice and 3 six sided dice if the player has 9 or 10 game pieces remaining. The player rolls 2 twelve sided dice and 2 six sided dice if the player has 7 or 8 game pieces remaining. The player rolls 2 twelve sided dice and 1 six sided dice if the player has 5 or 6 game pieces remaining. The player rolls 2 twelve sided dice if the player has 3 or 4 game pieces remaining. The player rolls 1 twelve sided die if the player has 1 or 2 game pieces remaining.

The first player next moves one of the game pieces a number a number of game spaces indicated on the die. One game piece is moved for each die rolled. The player may combine a pair of dice indicating a same number such that the game piece is moved a number of game spaces equal to the summation of numbers indicated on the pair of dice. The game piece may not be moved through two adjacent game spaces having a water obstacle thereon. When a player enters a game space having a water obstacle thereon, the player must wait until a next turn to move the game piece off of the water obstacle. The game piece may not move through another game piece, flag shaped tokens or rock pieces. The game pieces only move horizontally, vertically or diagonally, and moving one space diagonally equals two game spaces moved. The game piece may not be moved back to a same game space from which it started during the same turn.

Figure 8:
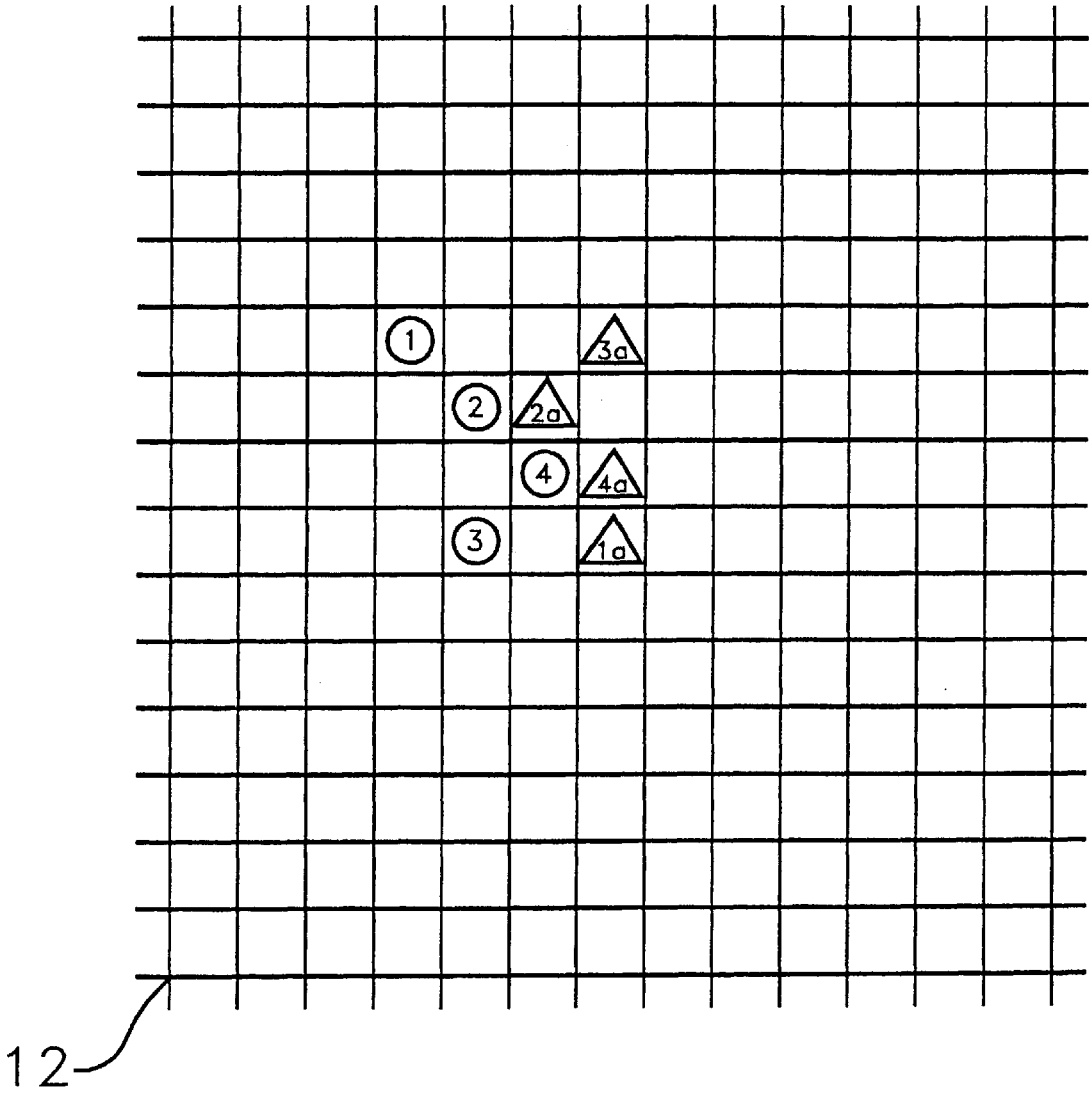
FIG. 8 is a schematic plan view of an example of game play according to the present invention.

The player who moves their game pieces has the option of attacking the opponent's game piece. Attacking the opponent's game piece includes:

1. Determining an attacking game piece and a defending game piece.
2. Determining if the opponent's defending game piece is within shooting range of an attacking player's attacking game piece. The shooting range is equal to eight minus a product of the cover value of the defending game piece times two. The shooting range is defined as a number of game spaces between the attacking and defending game pieces along a horizontal line, a vertical line or a diagonal line. As in movement of the game pieces, game spaces along the diagonal line counts as two spaces.
3. Adding one to the cover value of a player who has group advantage, the group advantage (GA) is defined as having a greater number of game pieces in range than an opponent. The GA remains as long as the number of game pieces within range is not even. The following are group examples as depicted in FIG. 8. By "shoot," within shooting range is meant.

If 1 can shoot 3*a*, 3*a* has the GA because of 1*a*.

If 1 can shoot 1*a*, 1 has the GA because of 2, 3, and 4 with 1 is more than 3*a* with 1*a*.

If 2 can shoot 1*a*, 2 has the GA because of 1, 2, 3, and 4 is more than 2*a* and 1*a*.

If 2 can shoot 2*a*, the GA is even because of 1*a* and 4.

If 3 can shoot 1*a*, 3 has the GA because of 1, 2, and 4.

If 4 can shoot 1*a*, 4 has the GA because 1, 2, 3 and 4 is more than 2*a*, 4*a* and 1*a*.

If 4 can shoot 2*a*, 2*a* has the GA because 2*a*, 4*a* and 1*a* is more than 2 and 4.

If 4 can shoot 4*a*, 4*a* has the GA because of 2*a* and 1*a*.

If 1*a* can 1, 1 has the GA because 1, 2, 3, and 4 is more than 3*a* and 1*a*.

If 1*a* can shoot 2, 2 has the GA because 1, 2, 3, and 4 is greater than 1*a* and 2*a*.

If 1*a* can shoot 3, 3 has the GA because of 1, 2 and 4.

If 1*a* can shoot 4, 4 has the GA because 1, 2, 3 and 4 is more than 1*a*, 2*a*, and 4*a*.

If 2*a* can shoot 2, the GA is even because 1*a* and 2*a* is equal to 2 and 4.

4. Rolling a six sided die by the attacking player and adding to the number indicated on the die the attacking player's cover value plus one if the attacking player has group advantage, as well as adding a benefit or detriment added by the indicia on the card drawn to get a first number. A player's cover value is the cover value of the obstacle or game board on which the player is standing.
5. Rolling a six sided die by a defending player and adding to the number indicated on the die the defending player's cover value plus one if the defending player has group advantage and the benefit or detriment added by the indicia on the card drawn by the attacking player to get a second number.
6. Removing the defending game piece from the game board if the first number is greater than the second number. The defending player attacks, in the same manner as indicated above, the attacking player if the first number is not greater than the second number.

When attacking a game piece, the range may not be extend through the flag game tokens or the rock pieces.

The game is won by placing one of the game pieces on a game space is occupied by an opponent's flag game token.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a game simulating paintball, said method comprising:

providing a game board, said game board having a plurality of grid line indicia thereon such that game spaces are defined;

providing a plurality of game tokens, at least two of said game tokens having a shape resembling a flag, a portion of said game tokens defining game pieces;

providing a plurality of obstacle pieces, providing said plurality of obstacle pieces comprising;

providing a plurality of water pieces, wherein water pieces define a cover value equal to zero;

providing a plurality of medium cover pieces, wherein medium cover defines a cover value equal to 2;

providing a plurality of game cards, each of said game cards having a side having indicia thereon, said indicia comprising positive and negative actions;

providing a chance means for determining movement about said game board, said chance means comprising a plurality of dice;

placing said obstacle pieces on said game board;

choosing a flag by each of said players and positioning said flags on of said game board;

selecting a quantity of game pieces to be used by each of said players based at least in part upon a desired length of play and desired complexity of play;

selecting spaces located on an associated one of said players portion of said game board on which to position each one of said quantity of game pieces previously selected, selection being based at least in part on each one of said players strategy;

positioning said game pieces on said game board by each player;

drawing one of said cards by a first player and performing said indicia on said card if possible;

rolling said dice by said first player;

moving one of the game pieces a number of game spaces indicated on said die, wherein one game piece is moved for each die rolled;

attacking the opponent's game piece, attacking the opponent's game piece comprising;

determining an attacking game piece and a defending game piece;

determining if the opponent's defending game piece is within shooting range of an attacking player's attacking game piece, said shooting range being based, at least in part, upon said cover value such that a higher cover value corresponds to a relatively shorter range and a lower cover value corresponds to a relatively longer shooting range;

rolling a die by a attacking player and adding to the number indicated on said die to the attacking player's cover value to get a first number;

rolling a die by a defending player and adding to the number indicated on said die to the defending player's cover value to get a second number;

removing said defending game piece from said game board if said first number is greater than said second number; and winning said game by placing one of said game pieces on a game space being occupied by an opponent's flag shaped game token.

2. The method of playing a game simulating paintball as in claim 1, wherein the step of providing said game board further comprises:

said game board comprising a magnetically receptive material; and wherein each of said game tokens has a base wall, each of said base walls comprising a magnetically active material, wherein each of said obstacle pieces comprising a magnetically receptive material.

3. The method of playing a game simulating paintball as in claim 1, wherein the step of providing said game tokens further comprises:

said game pieces having a shape resembling a soldier, half of said game pieces being colored blue and half of said game pieces being colored red.

4. The method of playing a game simulating paintball as in claim 1, wherein the step of providing a plurality of game cards further comprises:

said indicia being selected from the group comprising normal play, your goggles fogged and you will fire and return fire at 1 less cover value, camouflaged opponent receives cover value plus 1, you are camouflaged and receive cover value plus 1, opponent's goggles fogged and will fire and return fire at 1 less cover value, custom gun adds plus 1 to your cover value, friendly fire eliminates your game piece that is nearest an opponent and within range of another of your game pieces, opponent is out of paintballs and cannot return fire for one turn, paintball exploded in opponent's gun and opponent receives cover value minus 1, paintball exploded in your gun and you receive cover value minus 1, your equipment fails and you lose one turn, opponent's equipment fails and opponent loses one turn, your sniper is detected and becomes a regular game piece, your detect opponent's sniper who becomes a regular game piece, you are out of paint balls and can not fire for 1 turn, you are out of breath and cannot fire for one turn, opponent is out of breath and cannot fire for one turn.

5. The method of playing a game simulating paintball as in claim 1, wherein the step of attacking further comprises:

said shooting range being equal to eight minus a product of the cover value of said defending game piece times two, said shooting range being defined as a number of game spaces between said attacking and defending game pieces along a horizontal line, a vertical line or a diagonal line, wherein each game space along the diagonal line counts as two spaces.

6. The method of playing a game simulating paintball as in claim 1, wherein the step of attacking further comprises:

adding one to the cover value of a player who has group advantage, said group advantage being defined as having a greater number of game pieces in range than an opponent.

7. The method of playing a game simulating paintball as in claim 1, wherein the step of providing a chance means further comprises:

said plurality of dice being two sets of dice each set of dice comprising 2 twelve sided dice and 4 six sided dice; and said player rolling 2 twelve sided dice and 4 six sided dice if said player has at least eleven game pieces remaining, said player rolling 2 twelve sided dice and 3 six sided dice if said player has 9 or 10 game pieces remaining, said player rolling 2 twelve sided dice and 2 six sided dice if said player has 7 or 8 game pieces remaining, said player rolling 2 twelve sided dice and 1 six sided dice if said player has 5 or 6 game pieces remaining, said player rolling 2 twelve sided dice if said player has 3 or 4 game pieces remaining, said player rolling 1 twelve sided die if said player has 1 or 2 game pieces remaining.

8. The method of playing a game simulating paintball as in claim 7, wherein the step of moving said game pieces further comprises:

moving one of the game pieces a number of game spaces indicated on said die, wherein one game piece is moved for each die rolled, wherein said player may combine a pair of dice indicating a same number such that the game piece is moved a number of game spaces equal to the summation of numbers indicated on said pair of dice, wherein the game piece may not be moved through two adjacent game spaces having a water obstacle thereon, wherein a player entering a game space having a water obstacle thereon must wait until a next turn to move the game piece off of said water obstacle, wherein the game piece may not move through another game piece, flag shaped tokens or rock pieces, said game pieces only moving horizontally, vertically or diagonally, wherein moving one space diagonally equals two game spaces moved.

9. The method of playing a game simulating paintball as in claim 1, wherein the step of providing a game board further comprises:

said game board being colored a relatively light green color, said top side defining light cover, wherein said light cover defines a cover value equal to 1.

10. The method of playing a game simulating paintball as in claim 3, wherein the step of providing a plurality of obstacle pieces further comprises:

each of said water obstacle pieces comprising a plate having a blue color, wherein said water pieces define a cover value equal to zero;

each of said medium cover pieces comprising a plate having a relatively medium green color, wherein medium cover defines a cover value equal to 2; and a plurality of heavy cover pieces, each of said heavy cover pieces comprising a plate having a relatively dark green color, wherein heavy cover defines a cover value equal to 3.

11. The method of playing a game simulating paintball as in claim 5, further providing the step of:

providing a plurality of rock pieces, each of said rock pieces having a shape resembling a boulder, each of said rock pieces having a gray color, wherein said shooting range may not extend through said rock pieces.

12. The method of playing a game simulating paintball as in claim 6, wherein the step of providing a plurality of game cards further comprises:

said indicia being selected from the group comprising normal play, your goggles fogged and you will fire and return fire at 1 less cover value, camouflaged opponent receives cover value plus 1, you are camouflaged and receive cover value plus 1, opponent's goggles fogged and will fire and return fire at 1 less cover value, custom gun adds plus 1 to your cover value, friendly fire eliminates your game piece that is nearest an opponent and within range of another of your game pieces, opponent is out of paintballs and cannot return fire for one turn, paintball exploded in opponent's gun and opponent receives cover value minus 1, paintball exploded in your gun and you receive cover value minus 1, your equipment fails and you lose one turn, opponent's equipment fails and opponent loses one turn, your sniper is detected and becomes a regular game piece, your detect opponent's sniper who becomes a regular game piece, you are out of paint balls and can not fire for 1 turn, you are out of breath and cannot fire for one turn, opponent is out of breath and cannot fire for one turn.

13. The method of playing a game simulating paintball as in claim 6, wherein the step of providing a chance means further comprises:

said plurality of dice being two sets of dice each set of dice comprising 2 twelve sided dice and 4 six sided dice; and said player rolling 2 twelve sided dice and 4 six sided dice if said player has at least eleven game pieces remaining, said player rolling 2 twelve sided dice and 3 six sided dice if said player has 9 or 10 game pieces remaining, said player rolling 2 twelve sided dice and 2 six sided dice if said player has 7 or 8 game pieces remaining, said player rolling 2 twelve sided dice and 1 six sided dice if said player has 5 or 6 game pieces remaining, said player rolling 2 twelve sided dice if said player has 3 or 4 game pieces remaining, said player rolling 1 twelve sided die if said player has 1 or 2 game pieces remaining.

14. The method of playing a game simulating paintball as in claim 9, wherein the step of moving said game pieces further comprises:

moving one of the game pieces a number of game spaces indicated on said die, wherein one game piece is moved for each die rolled, wherein said player may combine a pair of dice indicating a same number such that the game piece is moved a number of game spaces equal to the summation of numbers indicated on said pair of dice, wherein the game piece may not be moved through two adjacent game spaces having a water obstacle thereon, wherein a player entering a game space having a water obstacle thereon must wait until a next turn to move the game piece off of said water obstacle, wherein the game piece may not move through another game piece, flag shaped tokens or rock pieces, said game pieces only moving horizontally, vertically or diagonally, wherein moving one space diagonally equals two game spaces moved.

15. The method of playing a game simulating paintball as in claim 6, wherein the step of attacking further comprises:

said shooting range being equal to eight minus a product of the cover value of said defending game piece times two, said shooting range being defined as a number of game spaces between said attacking and defending game pieces along a horizontal line, a vertical line or a diagonal line, wherein each game space along the diagonal line counts as two spaces.

16. The method of playing a game simulating paintball as in claim 13, wherein the step of attacking further comprises:

adding one to the cover value of a player who has group advantage, said group advantage being defined as having a greater number of game pieces in range than an opponent.

17. A game simulating paintball, said game comprising:

a game board, said game board having a top side and a bottom side, said top side having a plurality of grid line indicia thereon such that game spaces are defined, said top side being colored a relatively light green color, said top side defining light cover, wherein said light cover defines a cover value equal to 1, said game board comprising a magnetically receptive material;

a plurality of game tokens, each of said game tokens having a base wall, each of said base walls comprising a magnetically active material, at least two of said game tokens having a shape resembling a flag, at least twenty eight of said game tokens having a shape resembling a soldier and defining game pieces, half of said game pieces being colored blue and half of said game pieces being colored red;

a plurality of obstacle pieces, each of said obstacle pieces comprising a magnetically receptive material, said plurality of obstacle pieces comprising;

a plurality of water pieces, each of said water obstacle pieces comprising a plate having a blue color, wherein water pieces define a cover value equal to zero;

a plurality of medium cover pieces, each of said medium cover pieces comprising a plate having a relatively medium green color, wherein medium cover defines a cover value equal to 2;

a plurality of heavy cover pieces, each of said heavy cover pieces comprising a plate having a relatively dark green color, wherein heavy cover defines a cover value equal to 3;

a plurality of rock pieces, each of said rock pieces having a shape resembling a boulder, each of said rock pieces having a gray color;

a plurality of game cards, each of said game cards having a side having indicia thereon indicating positive and negative actions; and a chance means for determining movement about said game board.

18. A method of playing a game simulating paintball, said method comprising:

providing a game board, said game board having a top side and a bottom side, said top side having a plurality of grid line indicia thereon such that game spaces are defined, said top side being colored a relatively light green color, said top side defining light cover, wherein said light cover defines a cover value equal to 1, said game board comprising a magnetically receptive material;

providing a plurality of game tokens, each of said game tokens having a base wall, each of said base walls comprising a magnetically active material, at least two of said game tokens having a shape resembling a flag, at least twenty eight of said game tokens having a shape resembling a soldier and defining game pieces, half of said game pieces being colored blue and half of said game pieces being colored red;

providing a plurality of obstacle pieces, each of said obstacle pieces comprising a magnetically receptive material, said plurality of obstacle pieces comprising;

providing a plurality of water pieces, each of said water obstacle pieces comprising a plate having a blue color, wherein water pieces define a cover value equal to zero;

providing a plurality of medium cover pieces, each of said medium cover pieces comprising a plate having a relatively medium green color, wherein medium cover defines a cover value equal to 2;

providing a plurality of heavy cover pieces, each of said heavy cover pieces comprising a plate having a relatively dark green color, wherein heavy cover defines a cover value equal to 3;

providing a plurality of rock pieces, each of said rock pieces having a shape resembling a boulder, each of said rock pieces having a gray color;

providing a plurality of game cards, each of said game cards having a side having indicia thereon, said indicia being selected from the group comprising normal play, your goggles fogged and you will fire and return fire at 1 less cover value, camouflaged opponent receives cover value plus 1, you are camouflaged and receive cover value plus 1, opponent's goggles fogged and will fire and return fire at 1 less cover value, custom gun adds plus 1 to your cover value, friendly fire eliminates your game piece that is nearest an opponent and within range of another of your game pieces, opponent is out of paintballs and cannot return fire for one turn, paintball exploded in opponent's gun and opponent receives cover value minus 1, paintball exploded in your gun and you receive cover value minus 1, your equipment fails and you lose one turn, opponent's equipment fails and opponent loses one turn, your sniper is detected and becomes a regular game piece, your detect opponent's sniper who becomes a regular game piece, you are out of paint balls and can not fire for 1 turn, you are out of breath and cannot fire for one turn, opponent is out of breath and cannot fire for one turn;

providing a chance means for determining movement about said game board, said chance means comprising a plurality of dice, said plurality of dice being two sets of dice each set of dice comprising 2 twelve sided dice and 4 six sided dice, one of said sets being colored red and the other of said sets being colored blue;

providing two players;

placing one of said obstacle pieces on said game board by each of said players in turn until a desired amount of obstacles are positioned on said game board;

choosing a color by each of said players such that said players each receive said dice and said game pieces having said chosen color;

choosing a flag by each of said players and positioning said flag in opposite halves of said game board in a game space, wherein said flag may not be positioned within five game spaces of an edge of said game board;

positioning twelve of said game pieces on said game board by each player such that twenty-four game pieces are positioned on said game board, each of said game pieces being positioned in a game space, said game pieces being positioned behind a player's flag such that said game pieces must travel past a player's own flag on route to an opponent's flag;

drawing one of said cards by a first player, performing said indicia on said card if possible;

rolling said dice by said first player, said player rolling 2 twelve sided dice and 4 six sided dice if said player has at least eleven game pieces remaining, said player rolling 2 twelve sided dice and 3 six sided dice if said player has 9 or 10 game pieces remaining, said player rolling 2 twelve sided dice and 2 six sided dice if said player has 7 or 8 game pieces remaining, said player rolling 2 twelve sided dice and 1 six sided dice if said player has 5 or 6 game pieces remaining, said player rolling 2 twelve sided dice if said player has 3 or 4 game pieces remaining, said player rolling 1 twelve sided die if said player has 1 or 2 game pieces remaining;

moving one of the game pieces a number of game spaces indicated on said die, wherein one game piece is moved for each die rolled, wherein said player may combine a pair of dice indicating a same number such that the game piece is moved a number of game spaces equal to the summation of numbers indicated on said pair of dice, wherein the game piece may not be moved through two adjacent game spaces having a water obstacle thereon, wherein a player entering a game space having a water obstacle thereon must wait until a next turn to move the game piece off of said water obstacle, wherein the game piece may not move through another game piece, flag shaped tokens or rock pieces, said game pieces only moving horizontally, vertically or diagonally, wherein moving one space diagonally equals two game spaces moved, wherein said game piece may not be moved back to a same game space from which it started during the same turn;

attacking the opponent's game piece, attacking the opponent's game piece comprising;

determining an attacking game piece and a defending game piece;

determining if the opponent's defending game piece is within shooting range of an attacking player's attacking game piece, said shooting range being equal to eight minus a product of the cover value of said defending game piece times two, said shooting range being defined as a number of game spaces between said attacking and defending game pieces along a horizontal line, a vertical line or a diagonal line, wherein each game space along the diagonal line counts as two spaces;

adding one to the cover value of a player who has group advantage, said group advantage being defined as having a greater number of game pieces in range than an opponent;

rolling a six sided die by a attacking player and adding to the number indicated on said die the attacking player's cover value plus one if said attacking player has group advantage and a benefit or detriment added by said indicia on said card to get a first number;

rolling a six sided die by a defending player and adding to the number indicated on said die the defending player's cover value plus one if said defending player has group advantage and a benefit or detriment added by said indicia on said card to get a second number;

removing said defending game piece from said game board if said first number is greater than said second number, wherein said defending player attacks said attacking player if said first number is not greater than said second number;

wherein said range may not be extend through said flag game tokens or said rock pieces;

winning said game by placing one of said game pieces on a game space being occupied by an opponent's flag game token.

* * * * *